United States Patent [19]

Christy

[11] 4,086,746

[45] May 2, 1978

[54] PACKAGING MACHINES

[75] Inventor: Robert Fell Christy, Maldon, England

[73] Assignee: Robert Christy Engineering Limited, Ipswich, England

[21] Appl. No.: 804,917

[22] Filed: Jun. 9, 1977

[30] Foreign Application Priority Data

Jun. 10, 1976 United Kingdom ..... 24097/76

[51] Int. Cl.[2] ..... B65B 43/36

[52] U.S. Cl. ..... 53/188; 53/386

[58] Field of Search ..... 53/188, 386

[56] References Cited

U.S. PATENT DOCUMENTS

| | | | |
|---|---|---|---|
| 2,546,193 | 3/1951 | Lindstaedt et al. | 53/188 |
| 3,953,020 | 4/1976 | Ruf et al. | 53/188 X |

*Primary Examiner*—Travis S. McGehee

*Attorney, Agent, or Firm*—Prutzman, Hayes, Kalb & Chilton

[57] ABSTRACT

A machine for presenting bags successively to a filling spout or the like, comprising means for supporting a stack of bags with each bag in a generally vertical plane, means for separating the lower portion of the end bag of the stack from the remaining bags of the stack, means for lifting the separated lower portion of such bag to lift the bag until an upper marginal portion is clear of the stack, suction means for engaging opposed sides of the upper marginal portion of the bag, means for separating the said suction means to open the bag, and means for transporting the said suction means to carry the bag from the stack to the filling spout or the like.

6 Claims, 6 Drawing Figures

PACKAGING MACHINES

This invention relates to packaging machines, and more particularly to machines for picking one bag from a stack and presenting it, in an open condition, to a filling spout or the like.

The invention is primarily applicable to multi-ply paper bags having side gussets which give a modicum of stiffness to the bag, but is applicable to other types of bag having sufficient stiffness to be operated by the machine.

According to the invention there is provided a machine for presenting bags successively to a filling spout or the like, comprising means for supporting a stack of bags with each bag in a generally vertical plane, means for separating the lower portion of the end bag of the stack from the remaining bags of the stack, means for lifting the separated lower portion of such bag to lift the bag until an upper marginal portion is clear of the stack, suction means for engaging opposed sides of the upper marginal portion of the bag, means for separating the said suction means to open the bag, and means for transporting the said suction means to carry the bag from the stack to the filling spout or the like.

The separating means preferably includes suction cups to engage the exposed face of the end bag and separate it from the stack.

The lower end of the bag may be bowed against guides by the separating action to give extra stiffness to the bag for lifting.

The suction means engageable with the upper marginal edge of the bag may include suction cups mounted on separable arms themselves pivotally mounted on a carriage.

The invention will be further described with reference to the accompanying drawings, in which.

Figure 1:
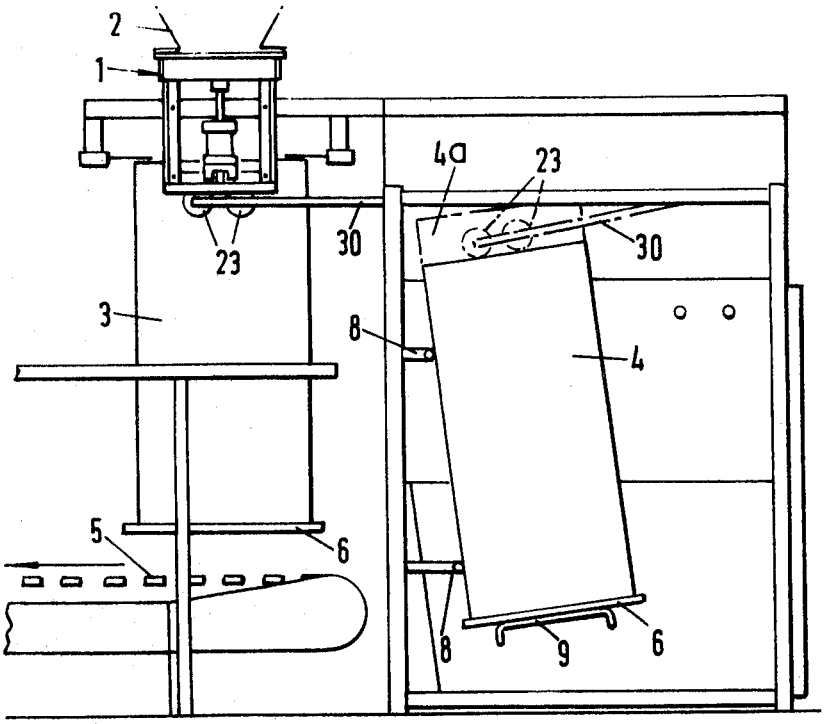
FIG. 1 is an elevation of a form of bag packaging machine to which the invention is applied.

FIG. 1 shows a bag packaging machine comprising a filling spout 1 arranged below a hopper 2. The hopper may contain such materials as animal feed, granular chemicals, potatoes or flour. Bags 3 are taken individually from a stack 4 by a bag handling mechanism to be described more in detail hereinafter, and opened before presentation to the filling spout 1. The bags are clamped successively to the filling spout for filling with a measured quantity, e.g., 25 or 50 Kg, of the contents of the hopper and then released onto a conveyor 5 which carries them to a sealing or tying device. The bags used are normally multi-ply paper bags having side gussets which give them sufficient longitudinal stiffness to be manipulated as hereinafter described, and the bottom of the bags are provided with a sewn paper tape, shown at 6, which means that in the closed state the bags are considerably thicker at the bottom than at the open top.

Figure 2:
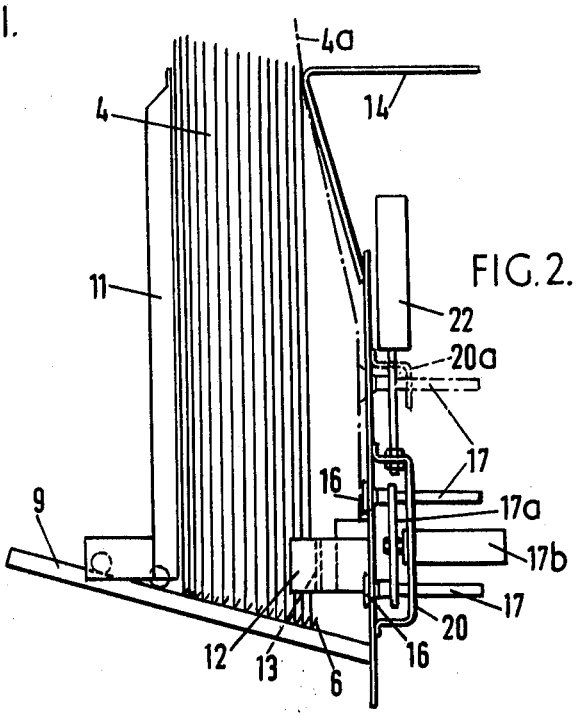
FIG. 2 is a side elevation of part of the bag handling mechanism of the machine of FIG. 1.

In the stack 4, the bags are somewhat laterally inclined as shown in FIG. 1 and are supported in this position by stops 8 and a platform 9 which is laterally inclined as shown in FIG. 1 and also inclined towards the machine as shown in FIG. 2. The platform 9 is slippery so that the bags slide easily down it, and behind the stack of bags there is located a wheeled backstop 11 which maintains the bags in a substantially vertical plane and ensures that the stacks of bags moves progressively towards the machine. The free face of the stack, remote from the backstop 11 is received between a pair of guides 12 carrying stops 13 to retain the lower part of the stack, and the upper part of the stack abuts a stop surface 14 which is closer to the backstop 11 than the stops 13 so that the stack assumes a backward-leaning attitude and cannot fall forwards. The taped bottom parts of the bags assist in the stack naturally assuming this attitude. This backward leaning attitude of the stack means that the weight of the stack is not exerted on the exposed bag at the end of the stack, and the pressure on this bag at the stop 14 is quite small.

Figure 3:
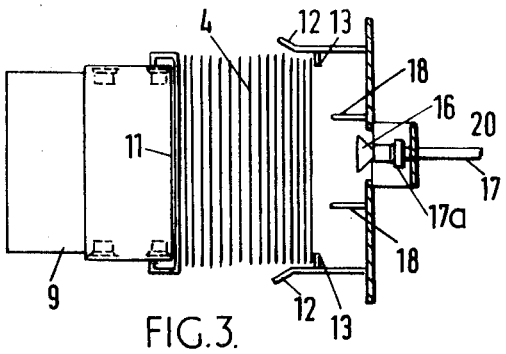
FIG. 3 is a plan view, omitting certain parts of the apparatus of FIG. 2.
Figure 4:
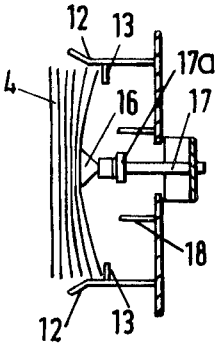
FIGS. 4 and 5 are scrap views of part of the sketch of FIG. 3, showing different stages in the cycle of operations.
Figure 5:
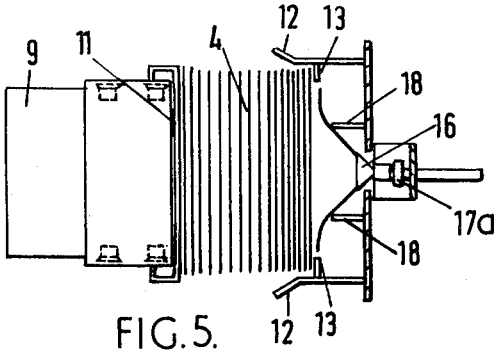

A pair of lower suction cups 16 are mounted on guides 17 linked by a cross beam **17*a* connected to a piston operating in a pneumatic cylinder 17*b*. Actuation of the cylinder 17*b* moves the guide 17 forward from the position shown in FIGS. 2 and 3 to that shown in FIG. 4 to engage the lower part of the outermost bag of the stack. The suction at the cups 16 is then turned on and when the cylinder 17*b* is actuated so that the guides 17 retract the cups 16, the lower part of the outermost bag is separated from the stack and drawn into a bow and clear of stops 13 as indicated in FIG. 5. This bowing is assisted by a pair of guides 18. The suction cups 16, guides 17 and cylinder 17*b* are mounted on a carriage 20 movable in a vertical direction by a pneumatic cylinder 22. Actuation of the cylinder 22 to lift the carriage 20 lifts the separated bag upwards so that an upper marginal portion of the bag is pushed clear of the stack 4 as indicated at 4*a* in FIG. 2. At this stage the carriage 20 has reached a position shown at 20*a***.

Figure 6:
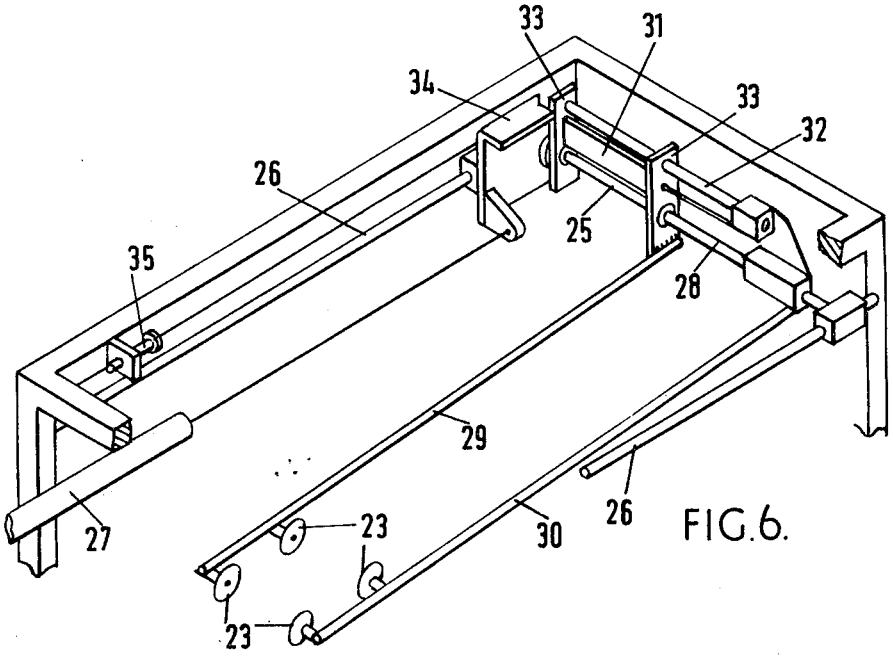
FIG. 6 is an isometric view showing another part of the bag handling mechanism.

The portion **4*a*, is also indicated in FIG. 1. The upper marginal portion 4*a* of the bag projecting above the stack 4 is then between two sets of suction cups 23 forming part of a lifting and transporting apparatus shown in more detail in FIG. 6**.

This assembly consists of a carriage indicated generally at 25 slidable along a pair of guide tubes 26 by means of a pneumatic cylinder 27. A cross tube 28 of the carriage supports a pair of arms 29 and 30 which carry the suction cups 23. The arm 29 is fixed in lateral position, and the arm 30 is slidable along the cross tube 28 and a second cross tube 32 by means of a pneumatic cylinder unit 31. The second cross tube 32 is pivotal around the cross tube 28 and connected thereto by plates 33, and normally, the weight of the arms 29 and 30 presses one of the plates 33 against a bracket 34 forming part of the carriage, so that the suction arms are normally inclined donwards at an angle of about 7°, as indicated in FIG. 1. In this position, the suction arms 29 and 30 are parallel with the top of the stack 4 and the suction cups 23 are in a good position to pick up the upper marginal portion of the lifted bag.

When the bag has been lifted, the cylinder 31 is actuated to draw the arm 30 towards the arm 29 so that the cups 23 are on opposite faces of the upper marginal portion of the bag. The suction is applied at cups 23 to ensure engagement and switched off at cups 16 so that the bag can be transported clear of the stack by bodily movement of the carriage 25 by means of the cylinder 27. During this motion, the cylinder 31 is again actuated to move the arm 30 away from the arm 29, and with the suction still applied to the cups 23, this has the effect of opening the bag. When the bag has reached a position below the filling spout 1, i.e., towards the end of the stroke of the cylinder 27, the plate 33 supported by the bracket 34 engages with a stop 35 above the path of the bracket 34, and this causes the cruss tube 32 to pivot about the cross tube 28 and thereby swing the arms to a horizontal position, thus lifting the bag up to the filling spout. The arm 30 is shown in FIG. 1 in this corresponding position. It is preferred to use a filling spout which expands into the bag top so that the opening by the cups 23 need only be a partial opening sufficient to allow the spout to enter. The clamping mechanism at the filling spout then engages the bag to hold it in position and the arms 29 and 30 are disengaged from the bag by cutting off the suction at the cups 23 and the movement of the cylinder 27 is reversed to withdraw the carriage. The arms 29 and 30 drop to their original inclined position and the cycle can then be repeated when a further bag is required.

Various modifications may be made within the scope of the invention.

I claim:

1. In a machine for presenting bags successively to a filling spout or the like: means for supporting a stack of bags with each bag in a generally vertical plane, means for separating the lower portion of the end bag of the stack from the remaining bags of the stack, means for lifting the separated lower portion of such bag to lift the bag until an upper marginal portion is clear of the stack, suction means for engaging opposed sides of the upper marginal portion of the bag, means for separating the said suction means to open the bag, and means for transporting the said suction means to carry the bag from the stack to the filling spout or the like.

2. A machine as claimed in claim 1, in which the separating means includes suction cups to engage the exposed face of the end bag and separate it from the stack.

3. A machine as claimed in claim 2, including guides to bow the lower end of the bag as it is separated.

4. A machine as claimed in claim 2, in which the lifting means comprises a device for lifting the suction cups bodily with the separated bag.

5. A machine as claimed in claim 1, in which the means for transporting the said suction means includes a carriage, in which the means for separating the end suction means includes separable arms mounted on the carriage and carrying the said suction means, which itself comprises separate suction cups engageable on opposite ends of the said upper marginal portion of the bag.

6. A machine as claimed in claim 5, in which the arms are mounted so as to be normally inclined donwardly, and comprising an abutment solid with the arms and a stop engageable by the said abutment as the carriage nears the end of its motion to lift the arms and thereby cause the bag to be lifted to the filling spout or the like.

* * * * *